United States Patent [19]

Perkins

[11] 4,027,732

[45] June 7, 1977

[54] TOOL FOR WASHING PERFORATIONS IN CASED WELL BORE

[75] Inventor: Lee E. Perkins, 127 Malibou Blvd., Houma, La. 70360

[73] Assignee: Kajan Specialty Company, Inc., Houma, La.

[22] Filed: Aug. 6, 1975

[21] Appl. No.: 602,414

[52] U.S. Cl. ..... 166/312; 166/147

[51] Int. Cl.[2] ..... E21B 37/00

[58] Field of Search ..... 166/312, 51, 147, 191, 166/311, 185

[56] References Cited

UNITED STATES PATENTS

| | | | |
|---|---|---|---|
| 2,073,126 | 3/1937 | Sweet | 166/147 |
| 2,214,121 | 9/1940 | Costello | 166/147 |
| 2,512,801 | 6/1950 | Kinney et al. | 166/312 |
| 3,169,580 | 2/1965 | Bateman | 166/147 |
| 3,396,798 | 8/1968 | Burns et al. | 166/147 |
| 3,760,878 | 9/1973 | Peevey | 166/185 |

*Primary Examiner*—James A. Leppink
*Attorney, Agent, or Firm*—Fleit & Jacobson

[57] ABSTRACT

Disclosed is a tool for injecting into or washing perforations in a cased well bore. The tool includes an outer housing and an inner mandrel with a fluid passage therebetween. Perforations are cleaned by discharging fluid from the passage into a region between closely spaced cups for maintaining pressure. Also disclosed is a valve system whereby the washing of perforations can be performed either by pumping fluid down the casing or the tubing string. The washing fluid discharged between the cups enters the perforations and is circulated behind the casing until reentering the casing bore through other perforations either above or below the cups. The fluid is returned to the well surface through the tubing by entering either from the tool bottom or through ports in the housing which are in communication with the inner mandrel.

29 Claims, 9 Drawing Figures

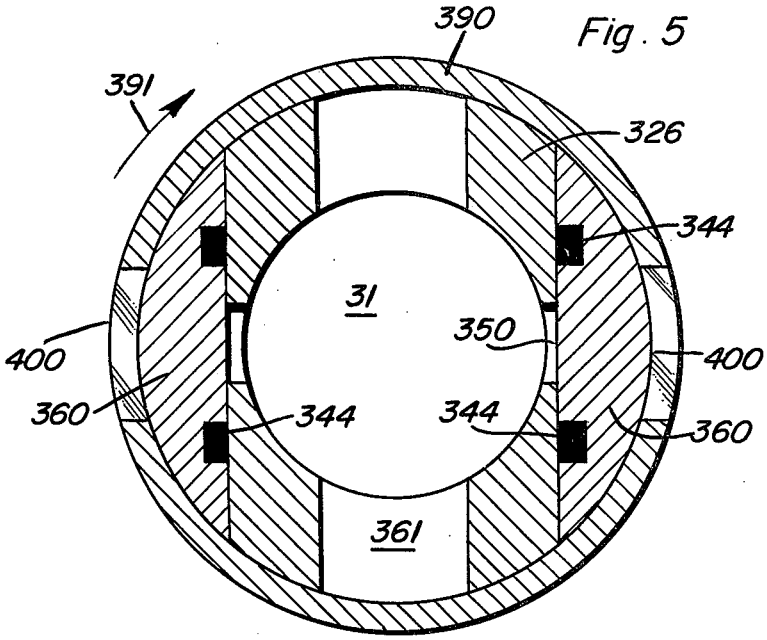
Fig. 5
Fig. 7
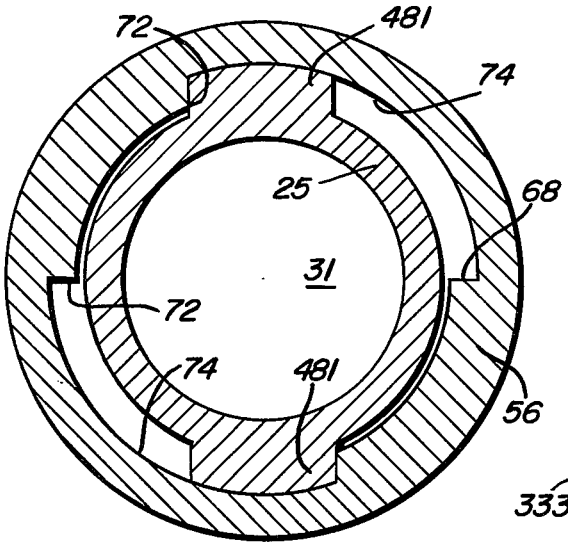
Fig. 9
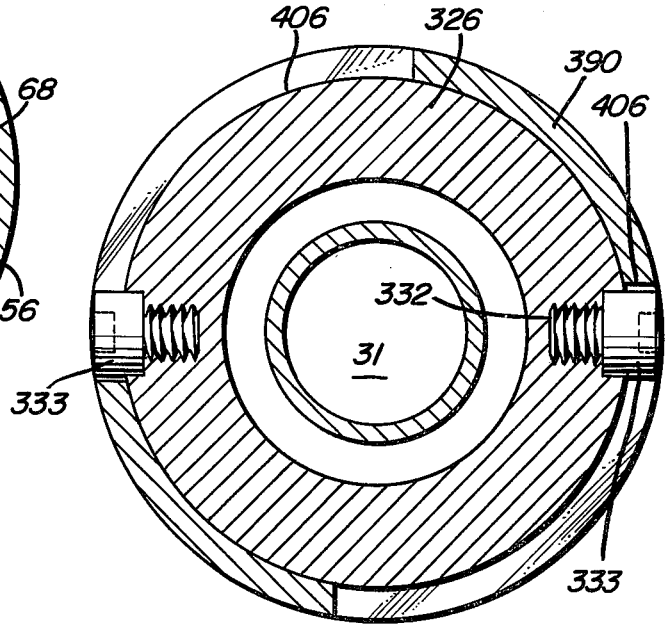

TOOL FOR WASHING PERFORATIONS IN CASED WELL BORE

Should the washing of a perforation require more hydraulic pressure than is permitted on the well casing, a valve is actuated to block the entry of fluid from the casing and to open a passage from the tubing to between the inner mandrel and housing and then to the ports between the cups. The same valve closes the passage between the interior and exterior of the inner mandrel so that fluid is pumped down the tubing at much higher hydraulic pressure for injection into the stubborn perforation. In this mode of operation fluid pumped into the perforation returns through other perforations to the casing bore, enters the bottom of the tool, travels up the interior of the inner mandrel to a port in communication with the annulus of the casing above the two closely spaced cups, and then travel up the annulus by traveling past the upper cup.

Actuation of a valve on the lower end of the tool readies the tool for clearing well sand. In this condition, fluid is pumped down the annulus of the casing and into the passage between the inner mandrel and the tool housing, exhausts through the lower valve into the annulus of the casing, and travels aroung the end of the tool, and into the interior of the inner mandrel for return to the surface through the tubing.

BACKGROUND OF THE INVENTION

When oil wells are drilled in the earth, it is common practice to set a string of steel in the well bore. The casing is perforated at the levels or intervals at which it is desired to extract oil from the surrounding formation, and these perforations require periodic cleaning to ensure unobstructed flow of oil from the group and into the casing. The present invention relates to a tool for washing perforations in a cased bore hole, and more particularly, to a tool for opening or cleaning the perforations in the casing for permitting unobstructed injection of material or entry of well fluids into the well casing.

At the present time, there are a number of tools available for washing the perforations of a well bore casing or for injecting into perforations. One such tool is a selective injection tool which operates on the principle of injecting fluid into each perforation, by pumping the washing fluid down the tubing and returning the fluid to the surface through the annulus between the washing tool and the casing of the bore. This type of tool requires a high pumping rate in order to carrying the debris or sand in water back to the surface. A method of washing commonly employed by this type of tool comprises injecting five barrels of wash water, and then reverse circulating this water to the surface of the well. This procedure is obviously time-consuming, because the entire capacity of the tubing must be circulated for each perforation.

There are other known wash tools similar to that described above, but having an additional cup positioned above the cups which surround the perforations. After injecting into each perforation by pumping down the tubing, the tool is raised to a position where by the additional cup is just below the uppermost perforation. Fluid is then pumped down the annulus at a very high rate, with the object of being diverted into the top perforations. These tools accomplish very little washing, however, because the tools are provided with an internal by-pass which permits most of the fluid to be exhausted out of the lower end of the tool, rather than through the perforations.

Another washing tool is disclosed in U.S. Pat. No. 3,760,878 issued to Peevey on Sept. 25, 1973. This patent describes a tool which permits washing of each perforation by pumping a fluid down the annulus and returning the debris or sand to the surface by a path up the tubing. This device has the disadvantage that the entire casing string must be pressurized in order to inject into a perforation. If the perforation to be washed has a high initial injection pressure, the high washing pressure may exceed the safe recommended pressure for the well casing.

The present invention overcomes each of the drawbacks noted above, and provides a washing tool which can safely and efficiently perform washing operations on each casing perforation regardless of the initial breakdown pressure, and which is also capableof reverse circulation of debris to the well surface.

SUMMARY OF THE INVENTION

Briefly stated, the present invention relates to a tool for washing or injecting fluid into perforations in a cased well bore. The inventive tool includes a fluid passage between an outer housing and an inner mandrel for discharging wash fluid between closely spaced cups. The tool also comprises a valve system for controlling whether the washing or injecting into the perforations is performed by pumping fluid down the casing (or annulus) around the tool or down the tubing string of the tool.

When pumping down the casing, the fluid is diverted by a cup located just below a crossover valve of the tool. The diverted fluid enters a passageway between the housing and the inner mandrel and is exhausted between closely spaced cups positioned opposite the perforation being washed. The fluid then leaves the casing through the perforation, to wash the same. The fluid then reenters the casing bore through other perforations either above or below that being washed, enters the tool either from the bottom or through ports in the housing which communicate with the inner mandrel, and is then returned to the well surface.

In the event that a perforation requires a more substantial hydraulic pressure for washing or injection, the fluid is pumped down the tubing string. The crossover valve located in a upper section of the tool is actuated to close the entry from the casing and open a passage from the tubing to the area between the inner mandrel and the housing and then to the ports between the closely spaced cups. Actuation of the crossover valve also closes the passage between the tubing and the inner mandrel. When the tool is in this mode of operation, fluid is pumped down the tubing for injection into the perforations between the closely spaced cups. Since the tubing is able to withstand pressures which are much higher than those which can be tolerated by the casing, this fluid path through the tubing enables the fluid to be pumped down the tubing at a much higher hydraulic pressure, and is well suited for washing or injecting into perforations having high injection pressures. The fluid pumped into the perforation returns to the region of the tool through other perforations in the casing bore. The fluid then enters the bottom of the tool, travels up the inner mandrel to a port in communication with the annulus of the casing above the closely spaced cups, and continues up the annulus bypassing the upper cup, and reaches the well surface.

The tool embodying the present invention also serves to remove well sand from deep in the well. The sand can be brought to the surface by opening a valve at the lower end of the tool. Fluid is pumped down the annulus of the casing and into the passage area between the inner mandrel and the tool housing. The fluid is exhausted, through ports in the lower valve, into the annulus of the casing and around the end of the tool. The fluid then enters the inner mandrel and returns to the surface.

It is accordingly a principal object of the present invention to provide a tool for injecting into or washing perforations in the casing of a well which includes valving for injecting or washing by flowing down the annulus and between pressure cups into the perforations, or down the tubing string between pressure cups into the perforations, and further including valving for washing out sand bridges.

A further object of the present invention is to provide an efficient tool which can be used to effectively wash or inject into perforations in a cased well bore regardless of the pressure required.

Another object of the present invention is to provide a tool which is able to wash or inject into perforations in a cased well bore, and yet reverse circulate debris to the surface.

A further object of the present invention is to provide a tool which can be used for washing and injecting into perforations, as well as for efficient removal of sand bridges.

These and other objects of the present invention, as well as many of the attendant advantages thereof, will become more readily apparent when reference is made to the following description taken in conjunction with the accompanying drawings.

BRIEF DESCRIPTION OF THE DRAWINGS

FIG. 5 is a cross section of the inventive tool taken along line 5—5 of FIG. 1, illustrating the components of the lower valve in a closed position;

FIG. 7 is a cross section of the tool taken along line 7—7 of FIG. 1;

FIG. 9 is a cross section of the tool taken along line 9—9 of FIG. 1.

DETAILED DESCRIPTION OF THE DRAWINGS

Figure 1:
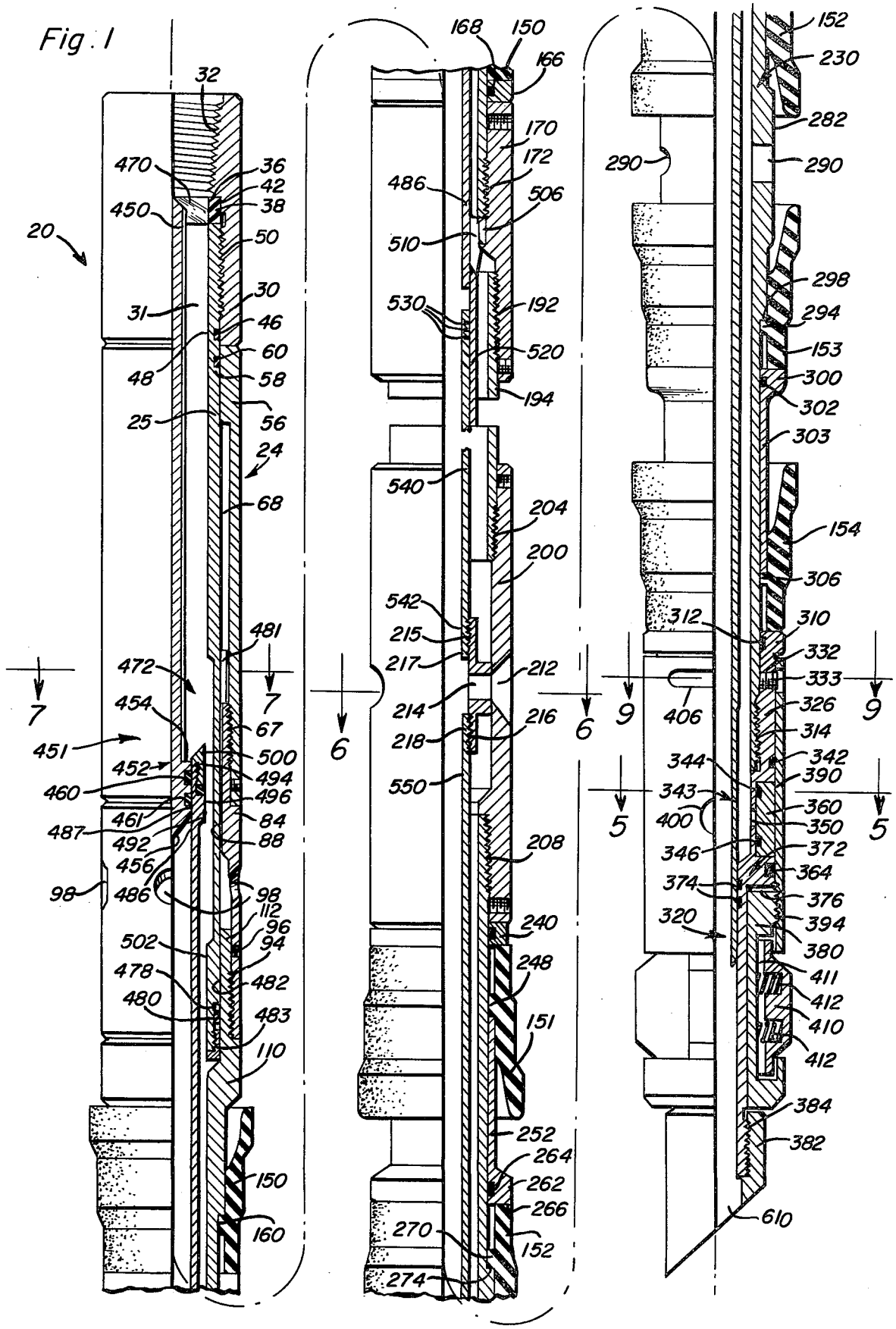
FIG. 1 is a longitudinally sectioned view of the washing and injecting tool embodying the teachings of the present invention.
Figure 2:
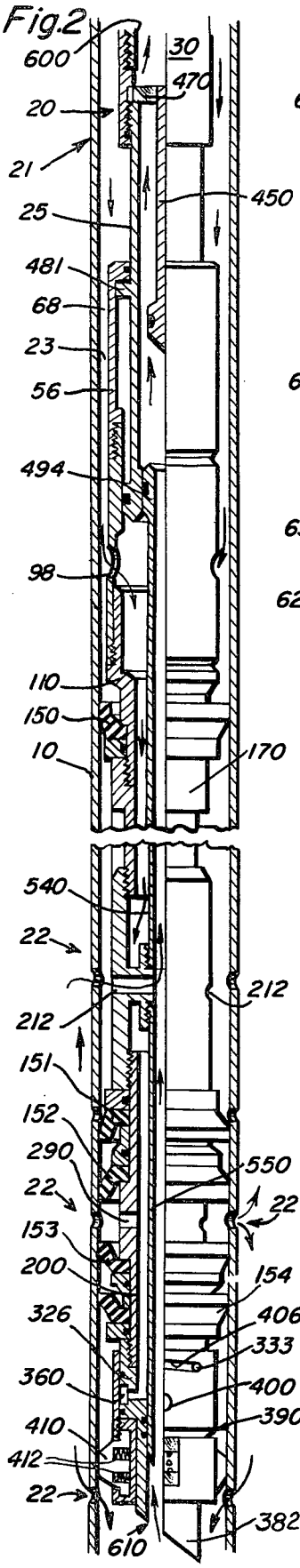
FIG. 2 is a longitudinally sectioned view of the inventive tool positioned in a well bore and capable of washing or injecting into a perforation by pumping fluid down the casing and returning the same to the surface through the tubing.

With reference first to FIG. 1 and 2, the basic components of the inventive tool will be described. The tool is shown generally at 20, extending downwardly into a well bore 21 into which is fit a casing 10 perforated as at 22. An annulus 23 is formed between the perforated casing 10 and the tool 20.

The tool 20 comprises a cylindrical outer casing 24 in which is telescopingly mounted a lug mandrel 25. Outer casing 24 comprises a plurality of interconnected sections. The uppermost is a top adapter 30 having a bore 31 therethrough and threads 32 on the upper region thereof for attachment to the lower end of a run-in tubing or drill pipe section 600. Adjacent the lower end of threads 32 is a shoulder 36 which forms the upper side of a recess 38 in the internal surface of bore 31. A ring 42 sits in recess 38 and is maintained in place by the upper end of the lug mandrel 25. Near the lower extremity of the top adapter 30 is an O-ring seal 46 seated in a groove 48 in the adapter 30 for sealing the adapter to the surface of the lug mandrel 25. The lug mandrel 25 and top adapter 30 are screwed together at 50.

A housing section 56 defines the next region of the outer casing 24. Housing 56 is cylindrical and in axial alignment with the top adapter 30. Near the top of housing 56 is a seal 58 residing in a seat 60. A C-slot 68 is formed in the housing 56 and extends substantially the entire length of the housing, terminating in a lower shoulder 66 and an upper shoulder 70. As seen best in FIG. 7, the housing 56 defines two C-slots 68, each being defined by radial faces 72 and circumferential faces 74.

The housing 56 is screw connected at 67 to a body 84, forming the next element of outer casing 24. The body 84, like housing 56, is cylindrical and in axial alignment with top adapter 30. The generally cylindrical inner surface of body 84 is shown at 88. A plurality of ports 98 extend through the surface of body 84, and permit fluid communication from the exterior of the tool 20 to the interior thereof when the mandrel 25 is raised, as well be later described.

The next section of outer casing 24, is a thimble 110. The thimble 110 is threaded to body 84 at 94, in the region of an upper thimble member 112. The thimble is fixed to body 84 through the means of a set screw 96 mating with a recess in upper thimble member 112. A shoulder 132 is formed on the outer surface of the timble 110 intermediate the two ends thereof.

A plurality of cups 150, 151, 152, 153 and 154 are positioned at spaced locations on the outer casing 24 of the tool 20. As best seen in FIG. 2, these cups seal the tool 20 against the well bore casing 10. Cup 150 is mounted around thimble 110 and has an inwardly directed ring 160 located below and abutting against the downwardly presented surface of the shoulder 132 on thimble 110. Holding the cup 150 against shoulder 132 is a metal shoe 166 sealed to the wall of thimble 110 by means of a seal 168. The metal shoe 166 retains cup 150 on the thimble 110 through the action of an adapter 170 which forms the next section of outer casing 124.

The adapter 170 is thread mounted on the thimble 110 as shown at 172. At its lower region, adapter 170 is screw connected, at 192 to a spacer 194. Spacer 194 can be comprised of any number of sections as will be later described, and serves to space the uppermost cup 150 in the well bore casing 10 so that this cup always remains above the uppermost perforation of the casing 10 when performing the washing operation.

Figure 6:
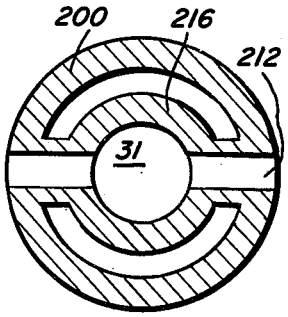
FIG. 6 is a cross section of the tool taken along line 6—6 of FIG. 1.

The next section of outer casing 24 is an equalizer body shown at 200. The equalizer body 200 is connected to the lower-most of the spacers 194, as shown at upper thread connection 204. The lower end of equalizer body 200 is also equipped with threads, as seen at 208. On the intermediate region of equalizer body 200 are positioned ports 212. As seen in FIG. 6, there are two ports 212 in body 200, on diametrically opposite sides of the washing tool. The ports 212 include cylindrical passageways 214, the inside regions of which are connected to mounting sleeves 215 and 216 having internal screw threads 217 and 218 respectively. As will be explained below, ports 212 enable fluid passage between the interior of the tool 20 and the annulus 23 between the tool and the well casing 10.

Attached to the lower region of equalizer body 200, at threads 208, is a mandrel 230. Mandrel 230 also forms part of the outer casing 24. As can be seen, cups 151, 152, 153 and 154 are mounted on mandrel 230 and, like cup 150, serve to form seals against the inner surface of casing 10. A support shoe 240 surrounds the mandrel 230 and supports the upper region of cup 151. The lower region of cup 151 is supported by an engaging ring 248 which lies in contact with the exterior surface of mandrel 230. A support shoe 262 having a upwardly extending sleeve 252 supports the lower region of cup 151 by contact with engaging ring 248. A seal 264 engages the outer surface of the mandrel 230.

The support shoe 262 has a lower, downwardly presented surface 266 which abuts against the downwardly presented cup 152. The cup 152 is mounted on the outer surface of the mandrel 230 by a ring 270, which in conjunction with a shoulder 274 of the mandrel 230, maintains the cup 152 in its place.

Between downwardly facing cup 152 and the cooperating upwardly facing cup 153 is a reinforced region of the mandrel 230. This region is seen at 282. Intermediate the cups 152 and 153, in the reinforced region 282 are a plurality of ports 290 for providing fluid communication between the annulus 23 of the well bore casing and the interior of the mandrel 230.

Like cup 152, cup 153 has a ring 294, the upper face of which engages a shoulder 298 on the exterior of mandrel 230. A support shoe 300 having a seal 302 associating with mandrel 230 is located beneath and supports the cup 153. A skirt 303 extends downwardly along the exterior of mandrel 230 and abuts the upwardly presented surface of a ring 306 on cup 154. A support shoe 310 having a seal 313 therein seats against mandrel 230 and supports the bottom of cup 154.

The lower region of the mandrel 230 is threaded at 314 and engages corresponding threads of a valve body 326. The upper surface of valve body 326 lies adjacent the downwardly presented face of support shoe 310. A threaded bore 332 is presented in the surface of valve body 326, and receives a stop screw 333 the top of which lies outside the surface of body 326. (See FIG. 9) The function of stop 333 will be latter discussed. Positioned in the outer surface of the valve body 326 are seals 342 and 364. Intermediate these seals 342 and 364 is a slotted region shown at 343, through which two ports 350 open into the core of the valve body 326. Two additional ports 361 (FIG. 5) extend through valve body 326 in the area of slotted region 343.

Figure 3:
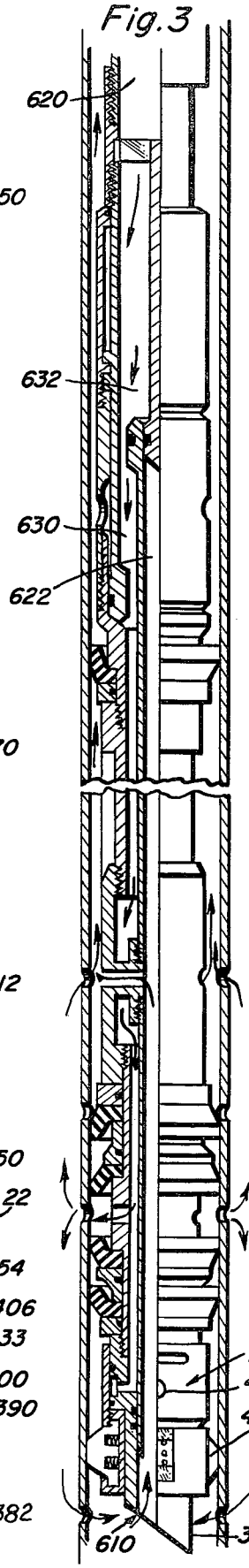
FIG. 3 illustrates the tool shown in FIG. 1, but set for washing or injecting into a perforation by pumping fluid down the tubing and returning the same to the surfaces through the casing.

As can be seen in FIGS. 1 and 3, the slotted region 343 houses a pair of valve inserts 360, each of which has two seals 344 and 346. The ports 350 lie beneath the respective valve inserts 360, and enable fluid pressure within the tool core to force the inserts 360 outwardly to facilitate sealing. The operation of the inserts 360 will be discussed in further detail below.

The valve body 326 includes a lower skirt section 320 having a reduced internal diameter and housing, at its upper region, a pair of seals 374. Opposite seals 374, and housing seal 364 is an outwardly extending region 372 of valve body 326. An abutment shoulder 376 defines the lower extremity of this extension 372. A drag block body 380 resides in the reduced diameter skirt 320 of the valve body, and abuts shoulder 376. A mule shoe adapter 383 is threadably attached to the skirt 320 of the valve body 326, at 384, to support the lower region of drag block body 380.

A ported cover 390 surrounds the outer surface of the valve body 326. As shown in FIG. 1, the seals 342 and 364 sealingly engage the interior of cover 390. The cover 390 has a slot 406 at the upper region thereof, extending approximately 90° and housing the screw stop 333. The cover may therefore be turned 90° as shown at 391 in FIG. 5, or until the stop screw 333 travels from one side of the slot 406 to the other. This 90° travel permits the lower valve to take an orientation where the ports 361 in valve body 326 are in alignment with corresponding ports 400 in the cover 390 in order to open the fluid passage between the interior of the tool 20 and the annulus 23. The lower valve is closed when in the orientation illustrated in FIG. 5. The valve is opened by rotating the cover 390 approximately 90° in the direction of arrow 391 so that the ports 400 in the cover align with those ports 361 in the valve body 326. This rotation of cover 390 is accomplished through the means of the drag block body 380 which is screw attached to the cover 390 at threads 394.

The outwardly facing surface of the skirt 320 on the valve body 326 defines pocket 411. Drag blocks 410 are housed in these pockets 411 and are maintained in contact with the casing 10 (FIG. 2) by means of biasing springs 412. The function of the drag blocks 410 is to generate frictional forces which will maintain the associated cover 390 fixed when the outer casing 24 is rotated from the well surface. In this manner, the lower valve can be controlled.

Still referring to FIG. 1, a description of the internal tool elements will now be presented. A rod 450 extends from just beneath the shoulder 36 of the top adapter 30, downwardly within the casing to a position adjacent the screw threads 67 in the housing 56. At the bottom of rod 450 is a valve shown generally at 451. Valve 451 comprises a shoulder 452 having an upwardly presented face 454 and a downwardly presented sloping face 456. A pair of seals 460 and 461 are positioned on the internal surface of the shoulder 452. The bore 31 is defined between the outer surface of the rod 450 and the inner surface of the lug mandrel 25. The rod 450 cooperates at its upper end with the lug mandrel 25 through fins 470 which are attached to the ring 42. The rod 450 is connected to the fins 470, as by welding and extends downwardly to the valve 451.

The internal surface of the lug mandrel 25 has an undercut region 472 wherein the internal diameter of the lug mandrel is increased. The function of the undercut region 472 will be described below. At the lower end of the lug mandrel 25, the internal diameter again decreases and presents a groove 478 for seating a seal 480. An end cap 483 is threaded to the bottom of lug mandrel 25 to hold seal 480 in its seat. The interior of body 84, at surface 88 cooperates with seal 480 when the lug mandrel 25 is elevated. The seal 480 seats against the interior surface 482 of thimble 110 when the mandrel 25 is oriented as shown in FIG. 1.

Lugs 481 are attached to the outer surface of the lug mandrel 25. These lugs slide in the C slot 68 of the housing 56 and, as will be discussed below, control the movement of the lug mandrel. In the position shown in FIG. 1, the lug mandrel 25 blocks the passage of fluid through ports 98.

Between the lug mandrel 25 and the rod 450 is a tube 486, the interior surface of which is denoted by 487. The upper end of tube 486 includes a ledge 492 for carrying a seal 496. A seal retainer 494 is threaded on tube 486 to hold the seal 496 in place. As shown in FIG. 1, seals 460 and 461 sealingly engage the interior surface 487 of the tube 486. The outer surface 500 of the tube 486 is in axial alignment with the inner surface 502 of lug mandrel 25 at its lower region beneath undercut 472. Thus, when the lug mandrel 25 is in its upper position, surfaces 500 and 502 are in sealed engagement.

At the lowermost end of thimble 110, is located a ring 506 to which are attached fins 510. The fins 510 are, in turn, welded to the tube 486 thereby associating tube 486 with the outer casing 24. A receptacle 520 is connected as by welding, to the tube 486 and fins 510. The inner surface of the receptacle 520 is sealed by O-ring seals 530 which are mounted in grooves on the outer surface of a spacer tube 540. The lower region of spacer tube 540 is threaded at 542 to mounting sleeve 215. The spacer tube may comprise any number of sections and serves to permit the distance between the cups 150 and 151 to vary in accordance with the total field of perforations 22 in the casing 10.

A lower tube 550 is threaded onto downwardly extending mounting sleeve 216, as shown at 218. The lower tube 550 extends downwardly and is sealed by seals 374, on valve body 326.

Figure 4:
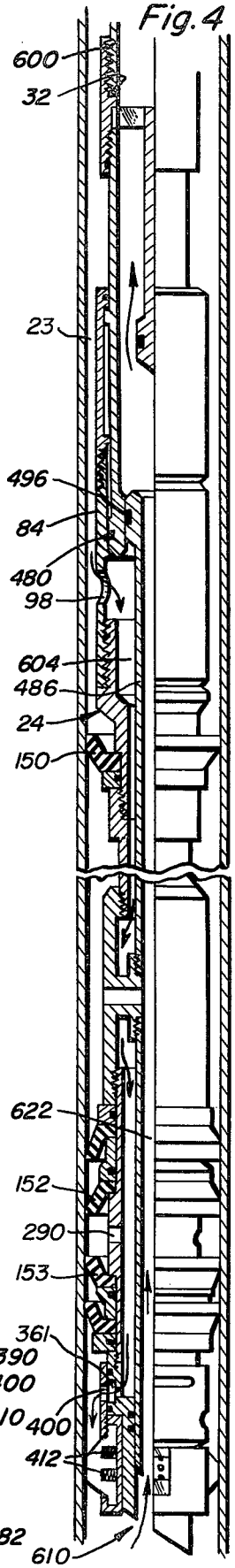
FIG. 4 is a longitudinally sectioned view of the inventive tool in the orientation for retrieval from a well, and also for washing out a sand bridge by pumping fluid down the casing and out the lower end of the tool, the fluid returning to the surface through the tubing.
Figure 8:
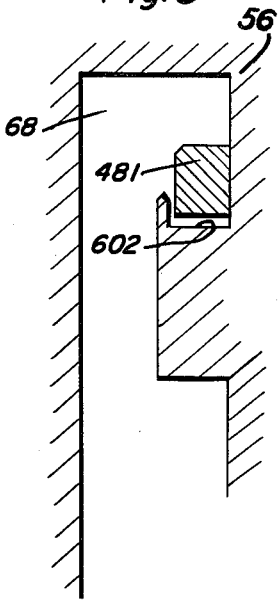
FIG. 8 is a vertical cross section of an upper portion of the tool illustrating the upper region of the control slot shown in FIGS. 1 and 7.

Having described the construction of the inventive washing tool, a description of a washing operation will now be presented. The tool 20 is attached to a tubing or drill pipe string shown generally at 600 in FIGS. 2 and 4. In readiness for lowering, the tool 20 is oriented as shown in FIG. 4. This is accomplished by moving the lug 481 of mandrel 25 from the lower position shown in FIG. 1 to the upper position. When in this position, and with the mandrel appropriately oriented in an angular sense, the lug 481 of mandrel 25 sits on a shelf 602 in the C slot 68, as shown in FIG. 8, to maintain the mandrel in its upper position. The orientation shown in FIG. 4 is the "open to annulus" position, with the port 98 opened to fluidly connect the annulus 23 to the passage 604 between the tube 486 and the housing 24 in the interior of the tool. The lower valve illustrated in FIG. 5 as being closed is open in the FIG. 4 orientation, with ports 361 in alignment with ports 400.

The tool is then lowered into the well bore casing 10 until, for example, a sand bridge is encountered. Pipe rams (or a hydril) are then closed around the tubing at the well surface and fluid is pumped down the annulus 23. As the cup 150 is upwardly opened and sealingly engaged with the inner surface of the well bore casing 10, the fluid being pumped down annulus 23 is not able to flow by this cup. The fluid is therefore diverted by the cup 150, enters the interior of the tool through the ports 98, flows downwardly in passage 604, and flows radially outwardly through open ports 361 and 400. The cups 152 and 153 prevent fluid from flowing into the annulus 23 through ports 290.

The fluid leaving the aligned ports 361 and 400 causes a reverse circulation which sashes the sand bridge out of the casing and carries the same to the surface via a return path upwardly through the open port 610 at the lowermost region of the tool and upwardly through the central bore 620 of the washing tool. The downward fluid flow and reverse circulation are shown by arrows in FIG. 4. After washing out the sand bridge to the desired depth, the tubing string is raised until the tool 20 is above the perforations 22. The tubing is then rotated in a counter-clockwise direction sufficiently to close the lower valve by sealing the ports 361 as shown in FIG. 5. An integrity test may then be conducted by pumping fluid down the annulus 23 until pressure reaches a predetermined level. This procedure can ensure that the tool is in the proper position, and can also verify that the cups are in working condition.

Upon completion of the integrity test, the fluid pressure is released and the tool 20 is lowered into a position wherein cup pairs 151 and 152, and 153 and 154 are positioned across the uppermost perforation 22.

This position and mode of operation of the tool is shown in FIG. 2. The pump is again actuated, and fluid is directed down the casing annulus 23. The fluid is diverted by the cp 150, enters axial bores 98 and exits the tool through ports 290. The fluid is thus directed between the cups 152 and 153, and toward the perforation 22. If injection occurs, the fluid seeks a return path through other perforations, enters the annulus 23 and travels toward the surface through the tubing. This procedure is repeated by aligning the perforations being washed between cups 152 and 153 until all of the perforations have been washed.

However, if one of the perforations is sufficiently clogged so that the fluid pressure developed by the above-discussed procedure is insufficient to effect washing, an alternative procedure is employed to enable higher pressures to be applied to the stubborn perforations. The alternative procedure is illustrated in FIG. 3, and comprises pumping fluid down the tubing through bore 622. By using this fluid path, the fluid pressure is exerted on the tubing and the internal bores of the washing tool rather than on the entire well bore casing 10.

To ready the tool to carry out the alternative procedure in the orientation shown in FIG. 3, the tool is raised and rotated clockwise (to raise the lug 481 from the confines of shelf 602) then lowered and turned counter-clockwise (closing down valve ports 400). This action closes the upper valve 451 and therefore ports 98. The same action opens the through tubing chamber 630 and blanks off the bore 622 from the fluid of the tubing, shown at 632.

The cup pairs 151 and 152 and 153, and 154 are then placed across the perforation requiring a high pressure, and hydraulic fluid is pumped in the tubing until a perforation breakdown occurs or until fluid injection can be conducted at pressures safe to the well casing. Once the stubborn perforation is washed, the tool is again operated in the mode illustrated in FIG. 2, with reverse circulation being established to wash the perforation.

After completion of the washing operation, the washing tool is returned to the orientation shown in FIG. 4 and is withdrawn from the well bore.

Numerous modifications and variations of the present invention are certainly possible in light of the above teachings. It should therefore be understood that the foregoing description has been given merely for purposes of illustration, and is in no way intended to limit the scope of the present invention. Rather, it is intended that the present invention may be practices otherwise than as specifically described above, and should be limited only as defined in the appended claims.

What is claimed is:

1. A tool for washing perforations in the casing of a cased well bore, the tool comprising:

an elongated cylindrical housing having a top adapted to connect to the lower end of a tubular member suspended in the casing;

first sealing means near the top of said housing, and adapted to be positioned above the uppermost perforation in said casing, for blocking the downward passage of fluid between said housing and said casing, but for enabling the passage of fluid in an upward direction, second sealing means below and spaced from said first sealing means for blocking the upward passage of fluid between said housing and said casing;

third sealing means below and closely spaced from said second sealing means for blocking the downward passage of fluid between said housing and said casing;

first fluid passage means through said housing between said second and third sealing means;

second fluid passage means through said housing above said first sealing means;

first valve means for selectively opening or closing said second fluid passage means;

third fluid passage means through said housing below said third sealing means;

second valve means for selectively opening or closing said third fluid passage means;

fourth fluid passage means through said housing intermediate said first and second sealing means;

fluid opening means at the bottom of said housing for enabling fluid to communicate between the interior of said housing and said well bore; and control means for operating said first and second valve means to open said second fluid passage means while said third fluid passage means is closed, to open said second fluid passage means while said third fluid passage means is opened, and to close said second fluid passage means while said third fluid passage means is closed.

2. A tool for injecting into or washing perforations in the casing of a cased well bore, the tool comprising:

an elongated tubular housing having an upper region for residing near the surface of the well bore and a lower region for residing deep in the well bore;

an elongated tubular mandrel mounted coaxially within said housing, at least a portion of said mandrel being mounted for axial movement relative to said housing and wherein the region between said housing and said mandrel defines an interior passage and the interior of said mandrel defining a central vertical bore from the upper to the lower regions of the tool;

first sealing means near the upper region of said housing for preventing downward passage of fluid in the casing annulus between said housing and said casing, and for permitting the passage of fluid in said casing annulus in an upward direction;

second sealing means below and spaced from said first sealing means for preventing the upward passage of fluid in said casing annulus;

third sealing means near but below said second sealing means for peventing the downward passage of fluid in said casing annulus;

first fluid passage means through said housing above said first sealing means for communicating said casing annulus with said interior passage;

first valve means for selectively opening or closing said first fluid passage means;

second fluid passage means through said housing intermediate said first and second means for communicating said casing annulus with said interior passage;

fluid opening means for enabling fluid to communicate between said central bore and said well bore; and control means for operating said first valve means in one mode to open said first fluid passage for enabling fluid to flow from said casing annulus in the upper region of the tool, through said first fluid passage, interior passage, second fluid passage, casing perforations and fluid opening, means, and up said central bore, back to the upper region of the tool, and in another mode to close said first fluid passage for enabling fluid to flow from said interior passage in the upper region of the tool, through said second fluid passage, casing perforations, fluid opening means, and up said casing annulus and said central bore.

3. The tool recited in claim 2, and further comprising third fluid passage means through said housing in the lower region of the tool for communicating said interior passage with said well bore; and second valve means for selectively opening or closing said third fluid passage means.

4. The tool recited in claim 3, wherein said second valve means is controlled from the surface of the well bore.

5. The tool recited in claim 4, wherein said second valve means includes an apertured sleeve associating with said third fluid passage means, wherein in a first position, an aperture of said sleeve aligns with said third fluid passage means to open same, and in a second position, said aperture is out of alignment which said third passage means to close same.

6. The tool recited in claim 5, wherein said second valve means further comprises holding means for maintaining said sleeve in a fixed orientation relative to said casing and means for rotating said housing relative to said casing.

7. The tool recited in claim 6, wherein said sleeve is maintained in said fixed position through the means of frictional contact with said casing.

8. The tool recited in claim 2, wherein said fluid opening means includes a passage at the lowermost region of the tool.

9. The tool recited in claim 8, wherein said fluid opening means further comprises at least one opening in said housing intermediate said first and second sealing means.

10. The tool recited in claim 2, wherein said first, second and third sealing means are rubber cups mounted on said housing and adapted to engage the interior wall of said casing.

11. The tool recited in claim 10, wherein said second and third sealing means each comprise a pair of cooperating cups.

12. The tool recited in claim 2, wherein the moveable portion of said mandrel has an upper and a lower position wherein in said upper position, said first fluid passage means is open and in said lower position, said first fluid passage means is closed.

13. The tool recited in claim 12, wherein the exterior surface of the moveable portion of said mandrel is sealed against the interior surface of the housing at two spaced locations, both said locations being above said first fluid passage means when the moveable portion of said mandrel is in its upper position and being on opposite sides of said first fluid passage means when the moveable portion of said mandrel is in its lower position.

14. The tool recited in claim 12, wherein the moveable portion of said mandrel maintains said upper and lower positions through the means of a lug and cooperating slot between the moveable portion of said mandrel and said housing.

15. The tool recited in claim 14, wherein said lug is integral with the moveable portion of said mandrel, and said slot is integral with said housing.

16. The tool recited in claim 14, wherein said slot is a vertical C slot provided with an upper shelf on which said lug sits when the movable portion of said mandrel is in its upper position.

17. A method for injecting into or washing perforations in the casing of a cased well bore with a well tool having a first sealing means near the upper region thereof for preventing downward passage of fluid in the casing annulus between the exterior of the tool and the casing, second sealing means below and spaced from the first sealing means for preventing the upper passage of fluid in the casing annulus, and third sealing means near but below the second sealing means for preventing the downward passage of fluid in the casing annulus, the method comprising the steps of:

lowering the well tool into the cased well bore with the second and third sealing means on opposite sides of a perforation, delivering a pressurized stream of fluid down the casing annulus above the first sealing means, directing the fluid into an interior passage of the well tool, and then out an opening in the interior wall of the well tool between the second and third sealing means and out the perforation between the second and third sealing means;

return circulating the fluid to the surface of the well through a central bore of the well tool; and should a perforation require a high pressure for injection or washing, adjusting the well tool and delivering a pressurized stream of fluid down the interior passage, out the opening between the second and third sealing means, through the high-pressure perforation and toward the surface of the well through the central bore and casing annulus.

18. A tool for washing perforations in the casing of a cased well bore which comprises:

an elongated cylindrical housing having a top adapted to connect to the lower end of a tubular member suspended in the casing and having an upper port and a lower port, an elongated tube concentrically aligned within said housing to define an interior annular fluid passage between said tube and said housing, said tube defining a cylindrical fluid passage therewith;

sealing means positioned below said upper port and above said lower port for blocking the downward and upward passage of fluid between said housing and said casing;

a further sealing means below said lower port for blocking the downward passage of fluid between said housing and said casing; and valve means or selectively opening and closing said upper port and said cylindrical fluid passage whereby fluid can be supplied to said lower port by passage down said cased well between said housing and said casing, into said upper port and said interior annular fluid passage, and recirculated up said cylindrical fluid passage or by passage down said cased well inside said housing, through said interior annular fluid passage, and recirculated to the surface between said housing and said casing.

19. A tool in accordance with claim 18 and further including a cross-over opening positioned between said first sealing means and said second sealing means which communicates said cylindrical fluid passage with the space between said housing and said casing to allow recirculating fluid to cross over between said cylindrical fluid passage and said space.

20. A tool in accordance with claim 18 wherein said valve means comprises a pair of rigidly interconnected axially aligned cylinder, one of which opens and closes said upper port and the other of which opens and closes said cylindrical fluid passage.

21. A tool in accordance with claim 20 wherein said valve means is operated by moving said axially aligned cylinders longitudinally with respect to said elongated cylindrical housing and said elongated tube.

22. A tool in accordance with claim 18 wherein said valve means includes a movable elongated mandrel having an upper and lower position in which said upper port and said cylindrical passage are open in the upper position and closed in the lower position.

23. A tool in accordance with claim 22 and further including lug and cooperating slot means between said mandrel and said housing to guide said mandrel between said upper and said lower positions.

24. A tool in accordance with claim 22 and further including means in cooperation with said valve means for retaining said valve means in said upper position.

25. A tool in accordance with claim 18 wherein said elongated cylindrical housing is threadedly connected to the lower end of a tubular member which extends to the well surface.

26. A tool for injecting into and washing perforations in the casing of a cased well bore and washing sand bridges in the well casing and recirculating debris to the well surface which comprises:

an elongated tubular housing having a top adapted to connect to the lower end of a tubular member suspended in the casing and defining an annulus between said housing and said casing;

a pair of spaced apart sealing means mounted on said housing and blocking the passage of fluid in said annulus between said sealing means;

means for injecting fluid from within said housing into a casing perforation positioned between said spaced apart sealing means;

an elongated tube positioned within said housing to define an interior annular fluid passage between said tube and said housing and containing a cylindrical fluid passage therewith; and valve means selectively opened and closed by rotation and counter-rotation of said tubular member which is positioned in the lower region of the tool for communicating said interior annular fluid passage with said well bore whereby fluid in said interior passage can pass into said well bore and recirculate up through said cylindrical fluid passage to the well surface.

27. The tool in accordance with claim 26 wherein said valve means includes a fluid passage means between said interior annular fluid passage and said well bore and an apertured sleeves associated therewith so that in a first position said aperture of the sleeve aligns with said fluid passage means to open same and in a second position is out of alignment with said fluid passage means to close same.

28. A tool in accordance with claim 27 wherein said valve mans further includes holding means for maintaining said sleeve in a fixed orientation relative to said casing and means for rotating said housing relative to said casing.

29. A tool in accordance with claim 26 wherein said elongated tubular housing is threadedly connected to the lower end of a tubular member which extends to the well surface.

* * * * *